United States Patent [19]

Ferri

[11] Patent Number: 4,732,136

[45] Date of Patent: Mar. 22, 1988

[54] TOY-ARM IMITATING A FIRE-ARM

[76] Inventor: Giampiero Ferri, Via Vecchia Fiesolana n.74 S. Domenico (fraz. Com. Fiesole), Firenze, Italy

[21] Appl. No.: 849,193

[22] Filed: Apr. 7, 1986

[30] Foreign Application Priority Data

Apr. 12, 1985 [IT] Italy ..... 11616/85[U]
Apr. 12, 1985 [IT] Italy ..... 11617/85[U]
Jan. 3, 1986 [IT] Italy ..... 11502/86[U]

[51] Int. Cl.[4] ..... F41B 11/00
[52] U.S. Cl. ..... 124/67
[58] Field of Search ..... 124/65, 66, 67, 68

[56] References Cited

U.S. PATENT DOCUMENTS 1,259,463 3/1918 De Fir ..... 124/67
3,765,396 10/1973 Kienholz et al. ..... 124/65

*Primary Examiner*—Richard T. Stouffer
*Attorney, Agent, or Firm*—Hopgood, Calimafde, Kalil, Blaustein & Judlowe

[57] ABSTRACT

A toy-arm imitating a portable fire-arm, operating by compressed air for the pneumatic launch of a light bullet, made up of two reciprocally movable carriers, one first of which comprises a cylinder lined up and communicating with the barrel and a reaction bearing for a spring acting on a piston to urge it into such a direction as to compress the air in the cylinder for the pneumatic launch of the bullet; the second carrier comprises an elastic tooth which hooks up the piston to drag it along while loading the spring, and the first carrier has a profile capable of gradually acting on the elastic tooth at the end of the relative stroke between the two carriers, until causing the release of the piston and its trip thanks to the loaded spring.

17 Claims, 10 Drawing Figures

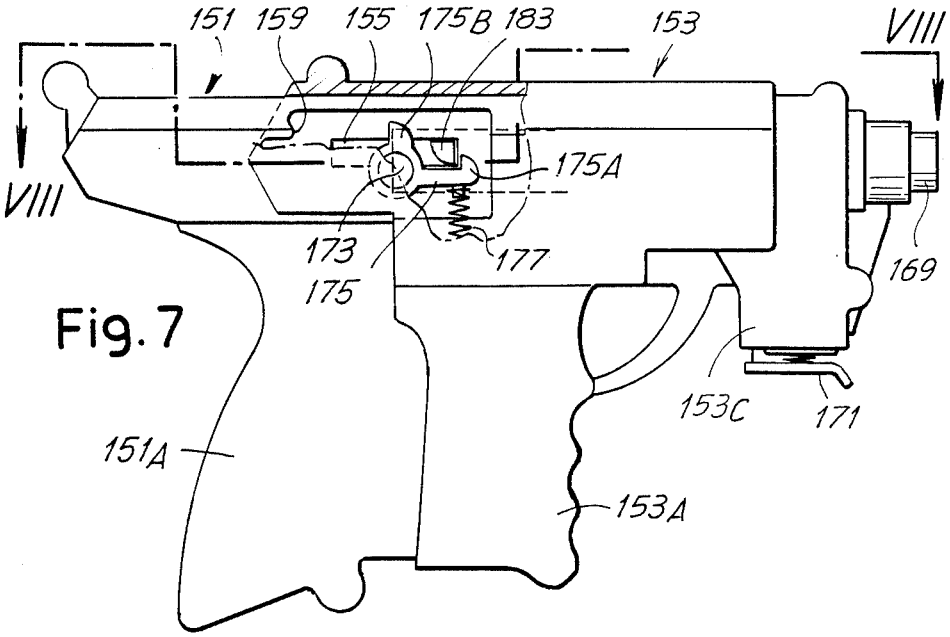
Fig. 7
Fig. 8
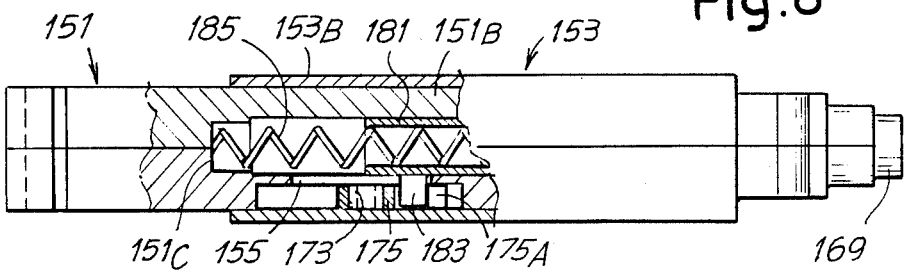
Fig. 9
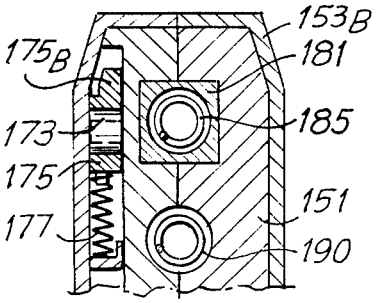
Fig. 10
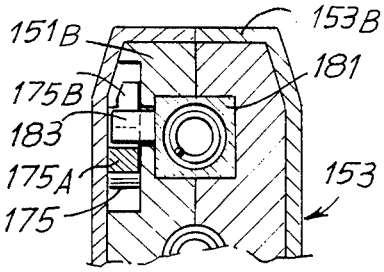

TOY-ARM IMITATING A FIRE-ARM

DESCRIPTION

The invention relates to a toy-arm, which is an imitation of a portable firi-arm, and which operates on compressed air for the pneumatic launch of a light bullet.

According to a feature, the invention provides two reciprocally movable equipment or carriers, one first of which comprises a cylinder lined up and communicating with the barrel and a reaction bearing for a spring acting on a piston to urge it into such a direction as to compress the air inside the cylinder for the pneumatic launching of the bullet; means are provided for loading the spring and the piston for the shot. It is a characteristic that the second carrier comprises an elastic or a spring actuated retention tooth which hooks up the piston to drag it along while loading the spring, and the first carrier has a profile or camming surface capable of gradually acting on the elastic tooth at the end of the relative stroke between the two carriers, until causing the release of the piston and its trip thanks to the loaded spring; and that the two carriers are elastically urged in a direction opposite to that determining, by manual control, the loading of the spring and the release thereof at the end of the stroke, so as to achieve a spontaneous return after the release. The retention tooth is, in practice, a pivotally mounted rocker-like oscillating lever, with one arm forming a retention tooth and the other cooperating with a camming surface or profile shaped as an inclined plane. The toy-arm may comprise—in a per se known manner—a bullets-feeding magazine.

According to another feature, the invention provides a toy-arm made up of two reciprocally movable carriers or equipments a first of which comprises a cylinder lined up and communicating with a barrel and a reaction bearing for a spring acting on a piston to urge it into such a direction as to compress the air inside the cylinder for the pneumatic launching of the bullet, means being provided for loading the spring and the piston for the shot. On one side, the second carrier comprises an elastic or spring actuation retention tooth which hooks up the piston to drag it along while loading the spring; and on the other side, the first carrier has a profile capable of gradually acting on the elastic tooth at the end of the relative stroke between the two carriers until causing the release of the piston and the trip thereof thanks to the loaded spring. The two carriers, slidingly movable one relative to the other, are handled by the operator in the two directions for the loading and the return strokes by means of two handles. The toy-arm advantageously comprises—in a per se known manner—a magazine apt to feed a bullet into alignment with an extension of the cylinder, from which the bullet is axially pushed into a barrel for the launch. The retention tooth may be a pivotally mounted rocker-like oscillating lever, with one arm forming a retention tooth and the other cooperating with a profile a camming surface shaped as an inclined plane. The toy-arm may be provided with a retention means which can be actuated for blocking the two carriers in at least one relative position, especially at the end of the stroke; said retention means may be elastic and capable of being neutralized by a trigger member to allow its working for the shot imitation. Said retention means is able to act at both positions of the end of the stroke. The retention means may be a peg sliding in a slot being parallel to the direction of the two carriers' relative slide motion and having two deviations into which the peg can penetrate because of an elastic thrust.

According to another feature, the invention provides a toy-arm made up of two reciprocally movable equipments or carriers, a first of which comprises a cylinder lined up and communicating with the barrel and a reaction bearing for a spring acting on a piston to urge it in such a direction as to compress the air in the cylinder for the pneumatic launch of the bullet; for the automatic release, the second carrier comprises an elastic tooth which hooks up the piston to drag it along while loading the spring, and the first carrier has a profile able to act on the elastic tooth at the end of the relative stroke between the two carriers, until causing the release of the piston and its trip thanks to the loaded spring; the two carriers being elastically urged in the direction opposite to that determining, by manual control, the loading of the spring and the release thereof at the end of the stroke so as to obtain the spontaneous return after the release; said manual control is achieved by means of two appendixes forming on the whole a handle and which are drawn close to each other by the clenching of the hand which grasps the arm so as to obtain the loading and the release at the end of the loading stroke; he toy-arm comprises—in a per se known manner—a magazine for feeding the bullets. The side retention tooth is, in practice, an oscillating lever, with an arm forming the retention tooth and an appendix cooperating with the pawl profile, all being disposed on a side of the fire-arm.

The drawing shows a feasible embodiment of the invention and in particular:

FIG. 7 is a viw through the opposite side of FIG. 6, with cutaway parts;

FIG. 8 is a section on line VIII—VIII of FIG. 7;

FIGS. 9 and 10 are local cross sections on lines IX—IX and X—X of FIG. 5.

Figure 1:
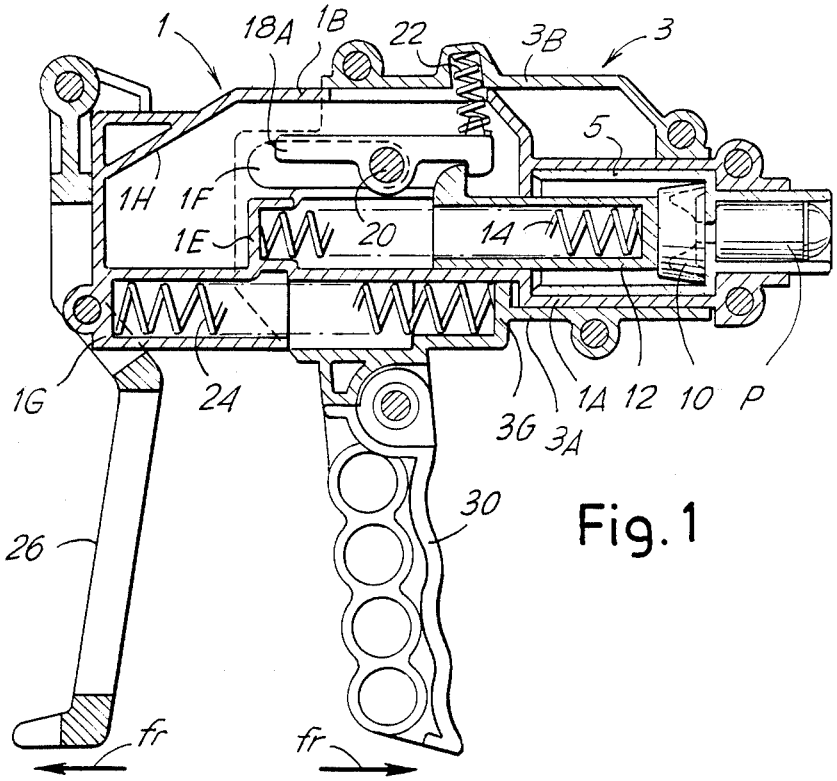
FIGS. 1 and 2 show a first embodiment in longitudinal section and both in the rest and shot positions, respectively.

In the drawing, shadings and hatchings of the sections are also drawn in correspondence to substantially symmetrical semi-shell surfaces being in contact or glued with each other.

Figure 2:
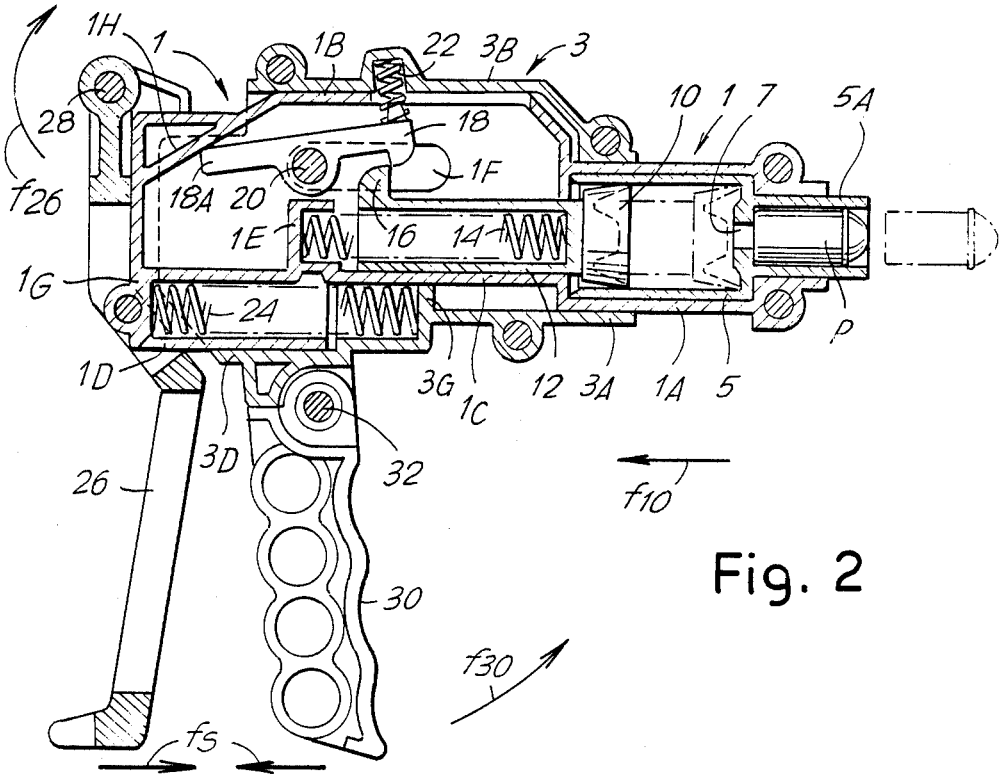

According to FIGS. 1 and 2, two equipments or carriers 1 and 3 are provided axially sliding one relative to the other, being guided by cylindrical or prismatic parts parallel to the direction of their relative motion. In particular, the carrier 1 has portions of walls 1A, 1B, 1C and 1D and the carrier 3 has portions of walls 3A, 3B, 3C, 3D, which cooperate with those of the carrier 1 to ensure the guide for the relative motion.

Inside the wall 1A, a pneumatic cylinder 5 is housed, which exhibits an extension 5A intended to receive a bullet P to be expelled by the compressed air passing from the cylinder 5 to the extention 5A through a hole 7. In the cylindner 5, a piston generally indicated by 10 and provided with a seal can slide, said piston being made up of a flexible glass-shaped sliding element which is mounted on a tubular stem 12 driving the same piston. The hollow stem 12 houses a spring 14 which reacts on a bottom 1E of the carrier 1. The moving backwards of the piston 10, according to arrow f10, causes the air input into the cylinder 5 and the compression of the spring 14. The release of the piston 10 after its backwards movement according to arrow f10 causes the trip of the spring 14 and the fast stroke of the piston 10 inside the cylinder 5 in a direction opposite to arrow f10, with consequent propulsion of bullet P outwardly from its seat 5A. To operate the loading stroke of piston 10 according to f10, a tooth 16 is provided which may be hooked up to an elastic or spring actuated retention tooth 18 carried by the carrier 3. In particular, the elastic tooth 1 is developed as a pivotally mounted rocker lever with an appendix or extension 18A at a certain distance from the tooth 18, and it is mounted on a transverse pin 20 carried by the carrier 3 and, in particular, by the sides thereof, the pin 20 going through a slot 1F provided on the sides of the carrier 1. The rocker-like tooth 18 is able to oscillate and is urged by a spring 22 in such a direction as to operate the hooking of the tooth 16, the two teeth 16 and 18 being provided with inclined backs for their relative sliding motion and for the consequent hooking in the condition shown in FIG. 1.

The two carriers 1 and 3 are elastically urged to their rest position (FIG. 1) by a spring 24 housed in a seat partially formed by the carrier 1 and partially formed by the carrier 3, and reacting on a bearing wall 1G of the carrier 1 and on a bearing wall 3G of the carrier 3.

The carrier 1 has a lever 26 articulated at 28 and which can be overturned or pivoted according to arrow f26 to a position brought down against the body of the toy-arm and shifted in the direction opposite to arrow f26 in order to be moved to an operative position as shown in the drawing. Correspondingly, the carrier 3 has also an operative lever 30, articulated at 32 to the same carrier and liable to be moved according to the arrow f30 to a position brought down against the body of the toy-arm and in the direction opposite to the arrow f30 in order to be moved to an operative position as shown in the drawing. The operative positions of levers 26 and 30 as shown in the drawing are defined by corresponding bearing pawls on the respective carriers. In the operative conditions, the two levers 26, 30 can be simultaneously grasped by the operator's hand, who can draw one lever close to the other and thus make the two carriers 1 and 3 slide one inside the other according to arrows fS of FIG. 2 in order to reach, from the rest position of FIG. 1, the shot position of FIG. 2; by abandoning or releasing the levers 26 and 30, the spring 24 causes the mutual moving away of levers 26 and 30 according to arrows fR of FIG. 1, so that they reach again the rest position.

In the rest position, the piston 10 is at the end of the stroke of that part of the appendix, that is, of the extension 5A, in which a bullet P may be already placed; the tooth 18, urged by the spring 22, hooks up the tooth 16; the two levers 26 and 30 are moved away from each other, and the springs 14 and 24 are allowed to be expanded or be stretched to a limited extent. The end 18A of the hooking tooth 18 finds itself at a distance from an inclined wall 1H distinctively formed inside the carrier 1.

By engaging the two levers 26 and 30 by the hand and bringing them close to one another according to arrows fS of FIG. 2, the piston 10, 12 is moved back from the position of FIG. 1 towards the position of FIG. 2 with a compression of the spring 14, and a compression of the spring 24 is also obtained, the two springs being, anyway, already pre-loaded in the rest condition. Towards the end of the "cocking" stroke, achievable as above described (through the approach of levers 26 and 30 according to fS), the end 18A of the retention tooth 18, comes into contact with the wall 1H and, therefore, after a relative approach of the two levers 26 and 30 and towards the end of the stroke—which is defined, in practice, by the length of the slot 1F—the end portion 18A, by coming into contact with the camming surface of the inclined profile 1H, causes the rotation of the rocker-like tooth 18, 18A around the pin 20 and against the action of the spring 22, thereby releasing the tooth 16 of the piston 10 therefrom; then, said piston, under the thrust of the loaded spring 14, performs a fast stroke inside the cylinder 5 in the direction opposite to arrow f10, thus causing the ejection of bullet P through the pneumatic effect of the air compressed by the piston 10. Therefore, the launching of the bullet takes place directly after a certain stroke of relative approach between the two levers 26 and 30 and without a specific release action through a trigger or other.

By ceasing the action on levers 26 and 30, the spring 24 moves again the two carriers 1 and 3 from the position of FIG. 2 to the one of FIG. 1, while hooking again the elastic or spring actuated tooth 18 to the tooth 16 for another launching operation, after the insertion of another bullet P into the appendix or barrel 5A and the successive mutual approach of the two levers 26 and 30.

According to FIGS. 3 and 4, a toy-arm is provided with a system for the automatic loading of bullets through a magazine that can be inserted and from which the bullets can be individually drawn out during the operations to be described below.

The toy-arm substantially comprises two carriers 51 and 53, which are able to slide one relative to the other as they are suitably guided in the longitudinal direction through mutually cooperating profiles and surfaces parallel to the direction of the relative motion. The carrier 51 has a handle 51A developed like the butt of a real arm and a longitudinal part 51B; between the butt 51A and the part 51B the bridge 51C for a trigger is also provided. The body 51B has longitudinal slots 55 on its sides, a bearing and reaction wall 51G in its inside and a seat for a cylinder 57 with a tubular extension 57A in its front part. Inside the body 51B an inclined profile 59 is formed for the purposes specified herebelow, which is located on the extension of slots 55 on the side of the butt 51A, that is, towards the rear part of the toy-arm. The body 51B carries a pin 61 on which a trigger lever 63, partially projecting inside the bridge 51C, can oscillate; the trigger lever 63 is elastically urged by a spring 65 which reacts on the piece forming the inclined profile 59. The lever 63 extends from the side opposite to the very trigger 63 beyond the pin 61 to exhibit at least a side peg 63A (or two opposite side pegs) which projects outwardly of the side of body 51B through an oblong hole or a slot 67 perpendicular to that indicated by 55.

The carrier 53 of the toy-arm has a handle 53A which develops correspondingly to that indicated by 51A, making up the butt of the arm, and a body 53B that slidingly receives the body 51B of the carrier 51, and cooperates with this body 51B for a longitudinal relative sliding motion. At the front end of the body 53B, the carrier 53 forms a seat for a short barrel 69 which is lined up with the extension 57A of piston 57, said extension being able to partially penetrate said barrel. The carrier 53 also forms a seat 53C perpendicular to the direction of the relative movement between the two carriers 51 and 53 and opened downwards for the insertion of a magazine 71. This magazine 71 houses a set of bullets P and an elastic pusher 71A which tends to push the bullets P upwards so as to present a bullet P in a withdrawal position P1 as shown in FIG. 3; the bullet being at the position P1 results lined up on one side with the barrel 69 and on the other side with the tubular extension 57A of the cylinder 57. The body 53B engages a transverse pin 73 going through two longitudinal slots 55 of the body 51B of carrier 51 and bears a rocker lever 75 for the oscillation thereof; said rocker lever makes up an elastic tooth 75A and an opposite appendix 75B; a spring 77, reacting on the carrier 53 through a lower longitudinal aperture in the body 51B, urges the rocker lever 75 and then the elastic tooth 75A upwards for an observer looking at the drawing. Said rocker lever 75, making up the elastic tooth 75A, finds itself in alignment with the profile 59 with which the end 75B of said elastic tooth is able to cooperate.

Within the cylinder 57, a piston 79, advantageously developed like a glass with an elastic rim, can slide, which piston 79 is solid with a big hollow stem 81 having a side tooth 83 capable of cooperating with the elastic tooth 75A, the two teeth 75A and 83 having invitation shaped backs for a mutual cooperation until hooking up to one another. Inside the hollow stem 81 a spring 85 for the trip is housed, which reacts on the bearing pawl 51C inside the body 51B of the carrier 51. On at least one of the sides of the body 53B surrounding the body 51B, a longitudinal recess 87 is formed, at each end of which an orthogonal deviation 89 is formed. The recess 87, along with the respective deviations 89, is able to cooperate with the corresponding peg 63A of the trigger 63, as the spring 65 urges the peg 63A to enter one of the deviations 89 as soon as it is lined up therewith. When a peg 63A finds itself within one of the deiviations 89 of the recess 87, the two carriers remain blocked one respect to the other either in the rest position of FIG. 3 or in the shot position of FIG. 4, if the deviations 89 at the ends of the recess 87 are in number of two. To allow a longitudinal relative sliding motion between the two carriers 51, 53, first it is necessary to act on the trigger 63 in order to remove the or each peg 63A from the deviation 89 where it is located, and it is also necessary to make a slight relative shifting between the two carriers 51 and 53 to move the or each peg 63A in the recess 87; after that, the relative sliding between the two carriers 51 and 53 is freely achievable until the end of the opposite stroke.

The two carriers 51 and 53 are able to be controlled by the operator by means of handles 51A and 53A which are engaged by the two hands, the hand engaging the butt 51A being also capable of achieving the manoeuvre on the trigger 63.

Figure 3:
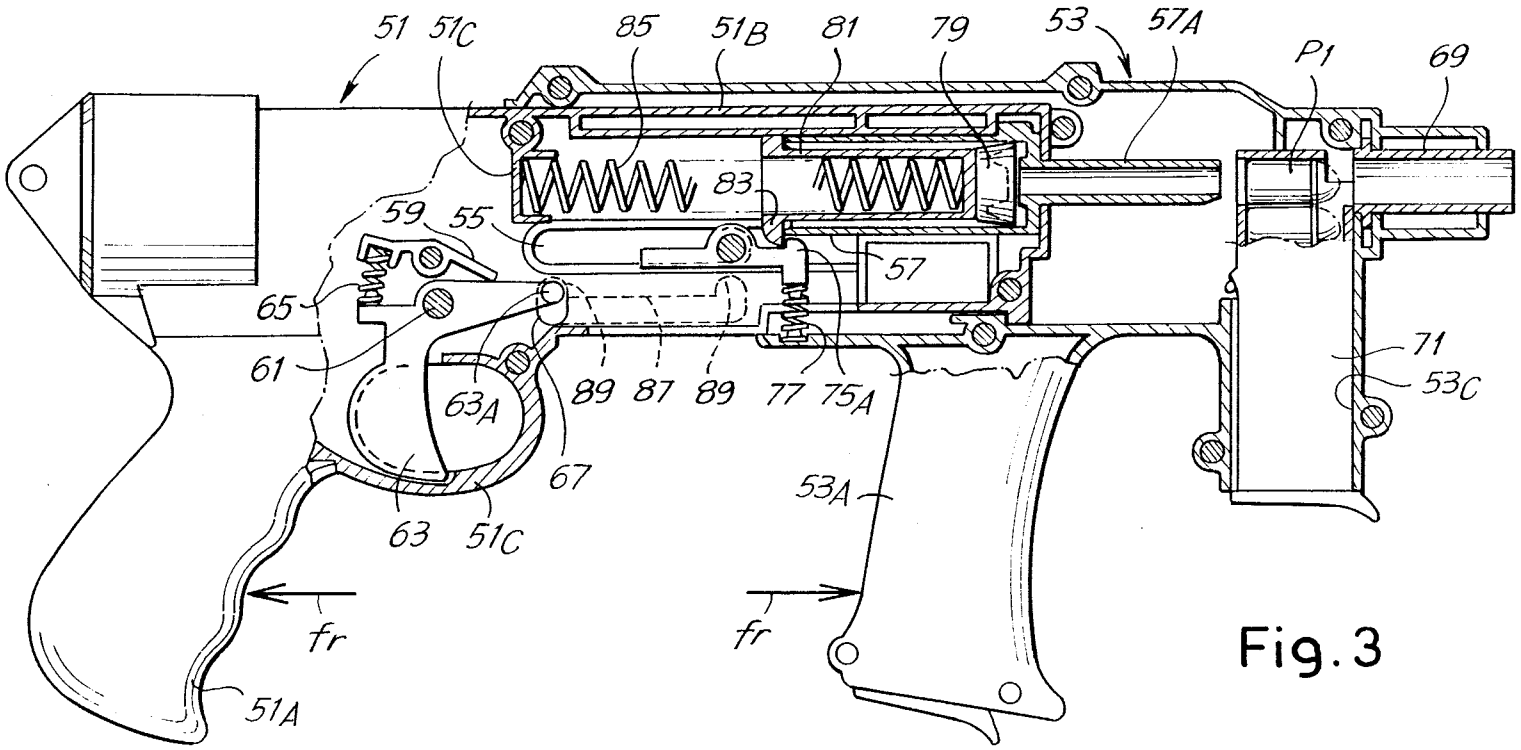
FIGS. 3 and 4 show a second embodiment, in longitudinal section and in the rest and shot positions, respectively.

In the rest position shown in FIG. 3, the two handles 51A and 53A are spaced apart at the longest mutual distance the piston 79 is at the end of the stroke, looking at the drawing, the extension 57A is in back position with respect to the magazine 71, a bullet P1 is pushed upwards, for an observer looking at the drawing, by the pusher 71A in alignment with the hollow tubular extension 57A and the barrel 69; the spring 85 is partially preloaded; the or each peg 63A is engaged in the deviation cavity 89 at the end of the slot 87 located on the left, for an observer looking at the drawing. This rest position is reached after acting on the two handles 51A and 53A according to arrows fR to move them away from each other. In the rest position of FIG. 3, the elastic tooth 75, 75A is engaged with the tooth 83 of the hollow stem 81 of the piston 79, and the pin 73 finds itself at the right end, for an observer looking at the drawing, inside the slots 55.

Figure 4:
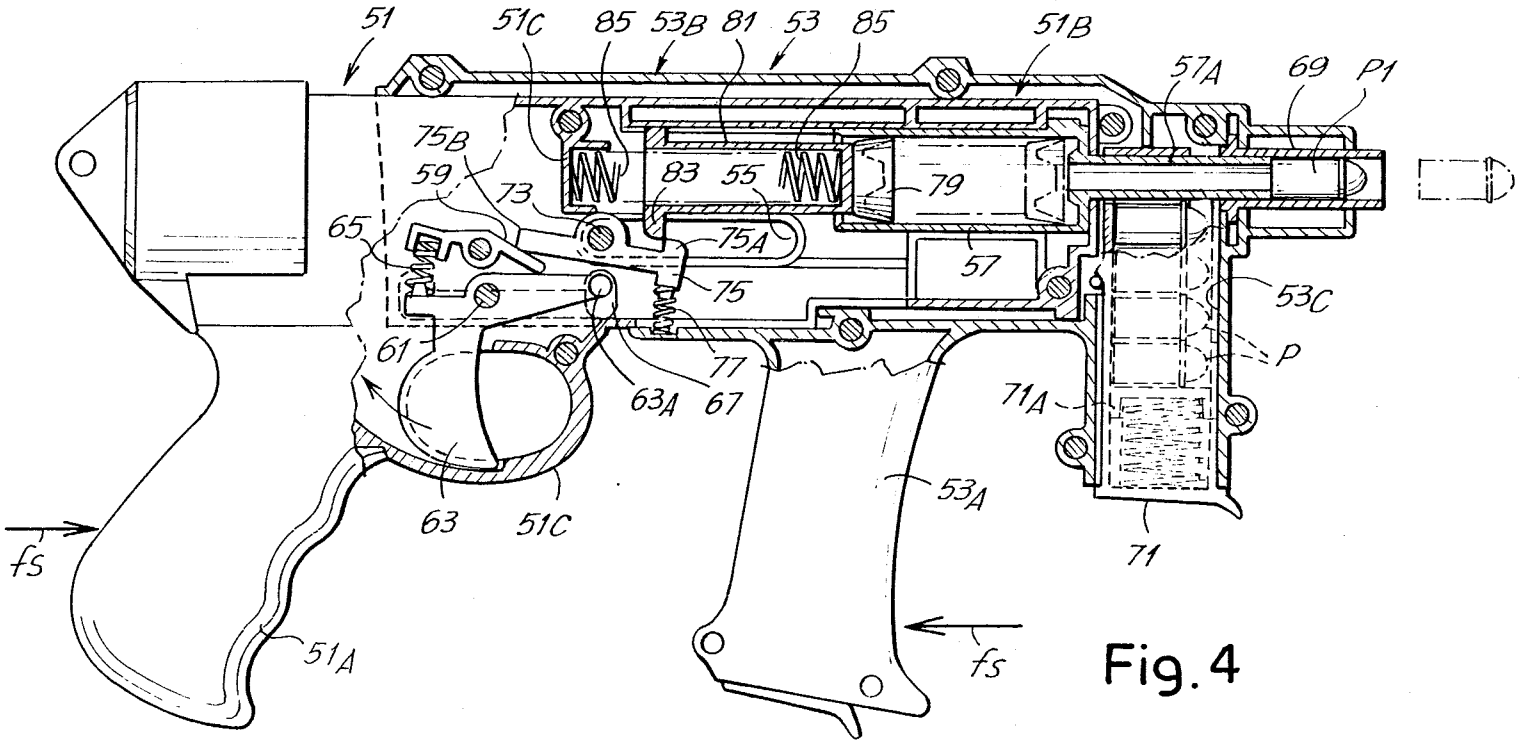

When it is desired to determine from the rest position the launch of a bullet, it is necessary to act on the two handles 51A and 53A according to arrows fS of FIG. 4, that is, in such a direction as to bring the two handles close to one another; to perform this operation firstly it is necessary to act on the trigger 63 to move the or each peg 63A out of the deviation in which it is engaged so as to dispose it into alignment with the slot 87 and allow the relative slidings between the two carriers 51 and 53. By bringing the two handles close to one another, the elastic tooth 75A is made to slide in the slot 75 and, thereby, the piston 79 is retracted from its extension 57A within the piston 57; the compression or the further compression of the tripping spring 85 and the approach of the end 75B of the rocker lever 75 of the elastic tooth 75A to the inclined profile 59, are obtained as well. By this relative displacement of the two carriers 51 and 53, the appendix, that is, the tubular extension 57A of the cylinder 57 penetrates the upper part of the magazine 71 and pushes the bullet to the high position P1 as far as inside the barrel 69, where said extension 57A also partially penetrates; the successive bullets held in the magazine 71 are prevented from being lifted owing to the fact that they come to rest on the extension 57A which crosses the upper part of the magazine 71.

Towards the end of the relative approach stroke between the two handles 51A and 53A, the end 75B of the rocker lever 75 of the tooth 75A reaches the profile 59 and comes into contact therewith; by the continuation of said approach, an inclination of the rocker lever 75 aainst the action of spring 77 is obtained up to the point of releasing the elastic tooth 75A from the retention tooth 83 of the stem 81 of piston 79; as a consequence, the spring 85 is suddenly released and pushes the piston 79 which then performs a stroke for the compression of the air which has gone inside the cylinder for violently pushing same air into the inner passage of the tubular extension 57A and thus causing the propulsion and launch of bullet P1 being brought into the barrel in the above described manner. At the end of the approach stroke of the two handles 51A and 53A, the launch of the bullet is thus automatically and directly accomplished; besides, the mutual engagement between the two carriers 51 and 53 can also be achieved if, once released the trigger 63, the or each peg 63A is able to enter the deviation 89 of the slot 87 which is at the right end of said slot 87 for an observer looking at the drawing; by keeping up the action on the trigger 63 or repeating the action on the trigger 63, the release between the two carriers is maintained or reset, respectively, thus allowing the relative moving away manoeuvre between the two handles 51A and 53A in the direction of arrows fR and, hence, the stroke for reaching again, from the shot position of FIG. 4, the rest position of FIG. 3 for another operation.

Through the relative moving away of the two handles 51A and 53A according to fR, the extension 51A slips out of the magazine 71 and, therefore, another bullet is pushed to the position P1 to be then dragged into the barrel 69 when another operation of relative approach, according to fS, between the two handles is carried out in order to repeat the already described operation by firstly acting, of course, on the trigger 63, to release the rest position otherwise maintained by pegs 63A being pushed by spring 65.

The toy-arm according to FIGS. 5 to 10 is provided with a system for the automatic loading of the bullets with a magazine that can be inserted and from which the bullets can be singularly drawn during the operations to be described below.

According to what is illustrated in FIGS. 5 to 10, the toy-arm substantially comprises two equipments or carriers 151 and 153 which are sliding one respect to the other as they are suitably guided in the longitudinal direction through mutually cooperating profiles and surfaces parallel to the direction of the relative movement. The carrier 151 has an appendix 151A and a longitudinal part 151B being at the inside of the carrier 153. The body 151B has a longitudinal slot 155 on a side, a bearing and reaction wall 151C in the inside and a seat for a cylinder 157 with a tubular extension 157A in the front part. Inside the body 151B, a pawl profile 159 is formed, for the purpose herebelow indicated, which is disposed on the extension of the slot 155 on the side of the appendix 151A, towards the back of the toy-arm.

Figure 5:
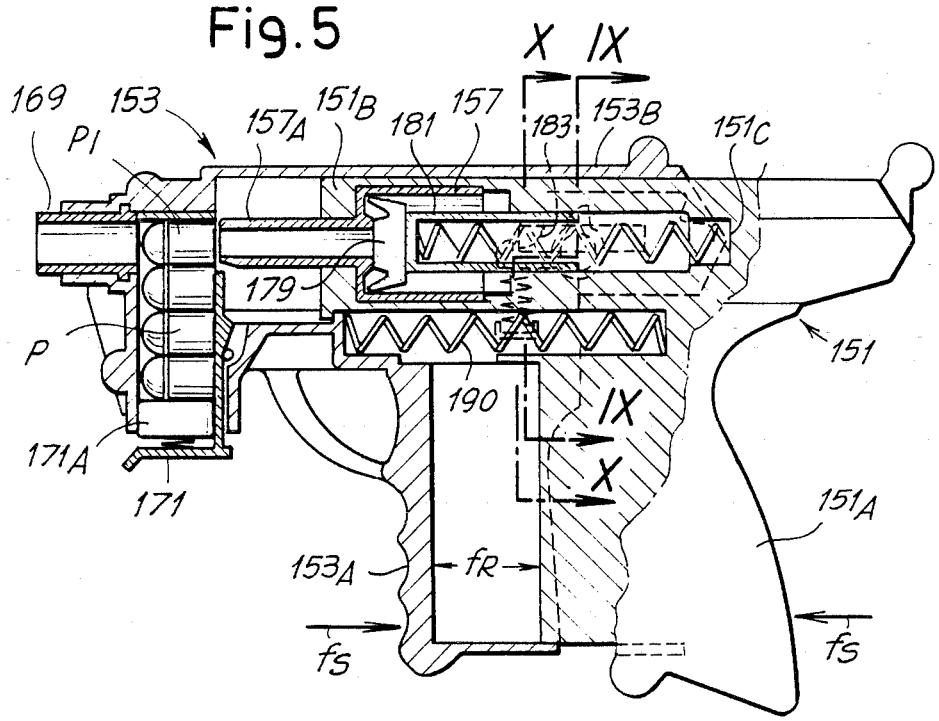
FIGS. 5 and 6 show another embodiment, in longitudinal section and in the two rest and shot positions, respectively.

The carrier 153 of the toy-arm has an appendix 153A which develops correspondingly to that indicated by 151A, making up with it a handle or butt. Said carrier has a body 153B which slidingly receives the body 151B of the carrier 151, and cooperates with this body 151B for a relative longitudinal slide motion. At the front end of the body 153B, the carrier 153 forms a seat for a short barrel 169, which results lined up with the extension 157A of the piston 157, said extension being able to reach said barrel. The carrier 153 also forms a seat 153C, perpendicular to the direction of the relative motion between the two carriers 151 and 153 and being open downwards, for the insertion of a magazine 171. This magazine 171 is apt to house a set of bullets P and an elastic pusher 171A, which tends to push the bullets P upwards against the wall 171B of the magazine, so as to present a bullet P1 in a withdrawal position as shown in FIG. 5; the bullet at the position P1 is aligned, on one side, with the barrel 169 and on the other side with the tubular extension 157A of the cylinder 157. The body 153B forms an inwardly projecting pin 173 which is located in front of the longitudinal slot 155 of the body 151B of the carrier 151; said pin supports a lever 175 for the oscillation thereof; said lever forms an elastic tooth 175A and an appendix 175B; a spring 177, reacting on the carrier 153, urges the lever 175 and then the elastic tooth 175A upwards for an observer looking at the drawing. Said lever 175, forming the elastic tooth 175A, finds itself in alignment with the pawl profile 159 with which an appendix 175B of said lever 175 of the elastic tooth 175A is able to cooperate.

Within the cylinder 157 a piston 179 slides, advantageously developed with an elastic lip, and a big stem 181 is solid to the piston 179, this stem being provided with a side tooth 183 capable of cooperating with the elastic tooth 175A; the two teeth 175A and 183 have invitation shaped backs for the mutual cooperation until they hook up one another. Inside the hollow steem 181, a trip spring 185 is housed, which spring reacts on the bearing pawl 151C inside the body 151B of the carrier 151.

Between the two carriers 151 and 153 a return spring 190 reacts, which spring tends to move the two appendixes 151A and 153A away from each other in the condition shown in FIG. 5. In this condition, the two appendixes 151A and 153A make up a handle which can be grasped by a hand. By clenching the fingers on the palm of the hand, the two appendixes are brought close to one another thereby causing the loading of the pneumatic piston and then the release thereof as described in the following; the approach of the two appendixes 151A and 153A, performed by the hand, provokes a further compression of the two springs 185 and 190.

In the resting position shown in FIG. 5, the two handles 151A and 153A are spaced apart of the longest mutual distance, the piston 179 is at the end of the stroke (in respect to its cylinder 157) on the left looking at the FIG. 5, the extension 157A is in back position with respect to the magazine 171, a bullet P1 is pushed upwards—for an observer looking at the drawing—by the elastic pusher 171A against the wall 171B of the magazine 171 into alignment with the hollow tubular extension 157A and with the barrel 169; the springs 185 and 190 are partially preloaded. This rest position is reached owing to the action of the spring 190, which has moved away the two appendixes 151A and 153A one from the other according to arrows fR. In said rest position shown in FIG. 5, the elastic tooth 175, 175A is engaged with the tooth 183 of the hollow stem 181 of piston 179.

Figure 6:
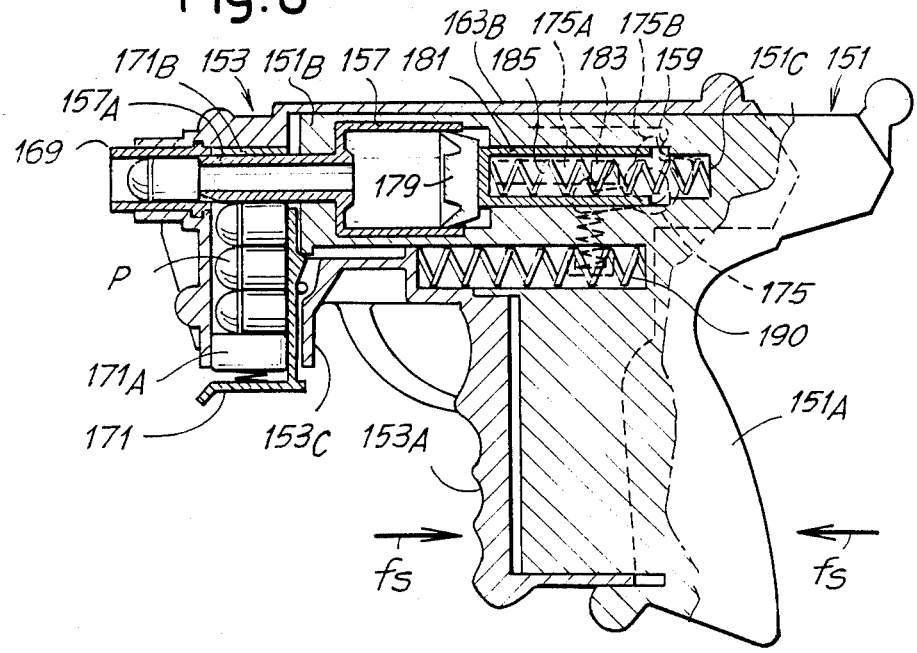

When, starting from this rest position, it is desired to cause the launching of a bullet, it is necessary to act on the two appendixes 151A and 153A according to arrows fS of FIGS. 5 and 6, that is, in such a direction as to bring the same appendixes close to each other; to carry out this operation, the hand clenches the two appendixes forming on the whole the handle. By bringing the two appendixes 151A and 153A close to each other, the elastic tooth 175A is made to slide and hence, the piston 179 is drawn back, along with its extension 181, inside the cylinder 157; moreover, the trip spring 185 is compressed or further compressed and the end 175B of the lever 175 of the elastic tooth 175A is moved near the pawl profile 159. By this relative movement of the two carriers 151 and 153, the tubular extension 157A of the cylinder 157 enter the upper part of the magazine 171 and pushes the bullet to the high position P1 as far as into the barrel 169; in this phase, the subsequent bullets P housed in the magazine 171 are prevented from being lifted because they come to rest on the extension 157A which crosses the upper part of the magazine 171.

Towards the end of the relative approach stroke of the two appendixes 151A and 153A, the end 175B of the lever 175 of tooth 175A reaches the pawl profile 159 and comes into contact therewith. With the continuation of said approach, an inclination of the lever 175 is caused against the action of the spring 177 as far as (FIG. 6) the elastic tooth 175A is released from the retention tooth 183 of the stem 181 of piston 179; the consequence of this is the trip or release of the spring 185 suddenly pushing the piston 179 to the left, looking at FIGS. 5 and 6, to perform a stroke for the compression of the air which has gone into the cylinder 157, and violently pushing same air into the passage inside the tubular extension 157A, thereby causing the propulsion and the launch of the bullet P1 which has been brought into the barrel 169 in the above described manner. The launch of the bullet is thus automatically and directly caused at the end of the approach stroke of the two appendixes 151A and 153A. By relaxing the hand, the spring 190 moves again the two appendixes away from one another and the toy-arm is brought again in the rest position of FIG. 1.

By the relative moving away of the two handles 151A and 153A according to fR, the extension 157A slips out from the magazine 171 causing a further bullet to be pushed to the position P1 to be then dragged into the barrel 169 when another operation of relative approach between the two appendixes according to fS is carried out in order to repeat the already described operation.

I claim:

1. A toy-arm configurated to imitate a portable fire arm which comprises:

a pair of first and second reciprocally movable carriers cooperatively and slidably assembled to provide a fire-arm having a first stroke of operation one with respect to the other which provides a bullet loading position in a barrel thereof and a second stroke in the opposite direction which provides a bullet-firing position from said barrel, a handle located at one end of said first carrier, said first carrier having upper and bottom wall portions which are movably and slidably disposed within said second carrier, said second carrier having a handle for the manual use thereof with the handle of said first carrier during an operation stroke, a fixed cylinder located in said first carrier coaxially aligned with a movably mounted cylinder in said second carrier which movable cylinder is capable of entering said fixed cylinder during a stroke operation, the aligned cylinders together having confined therein a reaction spring, said second carrier having retention means therein, said movably mounted cylinder in said second carrier having coupling means thereon for coacting with said retention means in said second carrier for spring loading said movable cylinder during an operation stroke, and means on said first carrier for coacting with said second carrier for releasing spring loading of said movable cylinder following an operation stroke.

2. The toy-arm according to claim 1, wherein the first carrier has a seat coaxial with a seat in the second carrier with a loading spring confined in and between the two seats, whereby through manual control of the respective handles of said carriers, the two carriers are urged to and from each other during an operation stroke.

3. The toy-arm according to claim 2, wherein the retention means on said second carrier is a pivotally mounted rocker arm having a retention tooth at one end thereof, and wherein the coupling means on said movable cylinder is a tooth which is hooked by said retention tooth during an operation stroke, said first carrier having a camming surface, said rocker arm having a camming extension opposite to the retention tooth for contacting said camming surface on said first carrier for releasing said coupling means following an operation stroke.

4. The toy-arm according to claim 3, wherein the retention tooth on the rocker arm is spring actuated to effect hooking contact with the tooth on the movable cylinder during an operation stroke, and wherein the camming surface on the first carrier is an inclined surface which is contacted by the camming extension of said rocker arm during an operation stroke to release the movable cylinder during a firing operation.

5. The toy-arm according to claim 4, wherein the rocker arm is mounted on a pivot peg which is slidably mounted in a recessed slot disposed in the direction of the relative movement of one carrier to another as the carriers move towards and away from each other during a complete cycle.

6. The toy-arm according to claim 3, wherein the camming surface on said first carrier is a pawl profile contoured to act gradually upon the camming extension of said rocker arm during an operation stroke, and wherein said toy-arm has spring-loading means for urging the two carriers in opposite directions from each other upon release of the handles on said carriers.

7. The toy-arm according to claim 6, wherein the handles of the first and second carriers are rigid and substantially parallel to each other, said handles being biased to move away from each other via said spring-loading means.

8. The toy-arm according to claim 1, including means for feeding a bullet into the barrel from which the bullet is subsequently launched.

9. The toy-arm according to claim 8, wherein the means for feeding a bullet into the barrel is a magazine which communicates with said barrel, said magazine having a spring-loading means for confining bullets in said magazine.

10. A toy-arm configurated to imitate a portable fire arm which comprises:

a pair of first and second reciprocally movable carriers cooperatively and slidably assembled to provide a fire-arm having a first stroke of operation one with respect to the other which provides a bullet loading position in a barrel thereof and a second stroke in the opposite direction which provides a bullet-firing position from said barrel, a handle located at one end of said first carrier, said first carrier having upper and bottom wall portions which are movably and slidably disposed within said second carrier, said second carrier having a handle for the manual use thereof with the handle of said first carrier during an operation stroke, a fixed cylinder located in said first carrier coaxially aligned with a movably mounted cylinder in said second carrier which movable cylinder is capable of entering said fixed cylinder during an operation stroke, the aligned cylinders together having confined therein a reaction spring, said movably mounted cylinder in said second carrier having a piston at one end thereof and a tooth at its other end next to the fixed cylinder, said piston being disposed in an air pressure cylinder, a rocker arm pivotally mounted in said second carrier having a spring-actuated tooth at one end thereof for hooking onto the tooth on said movable cylinder during a spring loading operation, said rocker arm having an extension at its other end for contacting a camming surface, and a camming surface located in said first carrier for coacting with the extension on said rocker arm and thereby unhook the spring-loaded movable cylinder and allow it to force the piston to compress the air in the air pressure cylinder and effect firing of a bullet inserted in said barrel.

11. The toy-arm according to claim 10, wherein the first carrier has a seat coaxial with a seat in the second carrier with a loading spring confined in and between the two seats, whereby through manual control of the respective handles of said carriers, the two carriers are urged to and from each other during an operation stroke.

12. The toy-arm according to claim 11, including means for feeding a bullet into the barrel from which the bullet is subsequently launched.

13. The toy-arm according to claim 12, wherein the means for feeding a bullet into the barrel is a magazine which communicates with said barrel, said magazine having a spring-loading means for confining bullets in said magazine.

14. The toy-arm according to claim 11, wherein the retention tooth on the rocker arm is spring actuated to effect hooking contact with the tooth on the movable cylinder during an operation stroke, and wherein the camming surface on the first carrier is an inclined surface which is contacted by the camming extension of said rocker arm during an operation stroke to release the movable cylinder during a firing operation.

15. The toy-arm according to claim 14, wherein the rocker arm is mounted on a pivot peg which is slidably mounted in a recessed slot disposed in the direction of the relative movement of one of said carriers to the other of said carriers as the carriers move towards and away from each other during a complete cycle.

16. The toy-arm according to claim 10, wherein the camming surface on said first carrier is a pawl profile contoured to act gradually upon the camming extension of said rocker arm during an operation stroke, and wherein said toy-arm has spring-loading means for urging the two carriers in opposite directions from each other upon release of the handles on said carriers.

17. The toy-arm according to claim 16, wherein the handles of the first and second carriers are rigid and substantially parallel to each other, said handles being biased to move away from each other via said spring-loading means.

* * * * *